US005444673A

United States Patent [19]

Mathurin

[11] Patent Number: 5,444,673

[45] Date of Patent: Aug. 22, 1995

[54] AUDIO CONTROLLED AND ACTIVATED WRISTWATCH MEMORY AND DEVICE

[76] Inventor: Trevor S. Mathurin, 865 Planders Ave., Uniondale, N.Y. 11553

[21] Appl. No.: 273,839

[22] Filed: Jul. 12, 1994

[51] Int. Cl.[6] ..... G04B 21/08

[52] U.S. Cl. ..... 368/63; 368/281; 368/282; 368/41; 368/107

[58] Field of Search ..... 368/63, 41–44, 368/281, 282

[56] References Cited

U.S. PATENT DOCUMENTS 4,508,457 4/1985 Aizawa ..... 368/63

5,369,797 11/1994 Tyree ..... 368/63

*Primary Examiner*—Bernard Roskoski

*Attorney, Agent, or Firm*—Michael I. Kroll

[57] ABSTRACT

An audio wristwatch is provided which consists of numerous functional features such as on/off, minutes, reset, next displayed message, previous displayed message, stop, time/date adjustment, save, erase, edit, and train enabling the user to verbally record, verbally retrieve and set alarms for appointments and tasks.

9 Claims, 5 Drawing Sheets

AUDIO CONTROLLED AND ACTIVATED WRISTWATCH MEMORY AND DEVICE

BACKGROUND OF THE INVENTION

Field of the Invention

The present invention relates to an audio controlled and activated wristwatch memory aid device control system for monitoring appointmenmts and tasks, and more particularly to a control system for voice commanding appointments and tasks.

The present invention relates to an audio controlled and activated wristwatch memory aid device which provide for the entry of data by voice recognition reading or keying of the characters of the data, and particularly to an improved terminal where data entry operations do not interfere withother operations as may be required to data with respect to which is to be read or entered, thereby, reducing the time and increasing the efficiency and productivity of information management operations.

The invention relates generally to voice recognition, and more particularly to speaker dependent voice recognition applied to information communication systems, and is more specifically directed towards a method for programming communication devices to recognize and respond to voice commands.

DESCRIPTION OF THE PRIOR ART

The invention is especially suitable for providing a portable transaction or data entry terminal which is battery operated and which may be used to gather data concerning information both by key entry of the data and by operation of a verbal reader containing the information, all of which are embodied by a single unit which is utilized by the user so that the information acquisition on entry operations do not interfere with the use of voice commands to pick and place information in the course of information management operations.

Portable information transaction terminals, including voice scanners and readers and keyboards integrated into the terminal to provide a unitary terminal, are in general use for information management and control. These terminals include housing for the voice recognition scanner, display screen and the electronics associated wherewith, computer chips, keyboards and displays. The form of such terminals vary, but most comprise a trigger operated scanner and keyboard on the surface of the scanner housing (See U.S. Pat. No. 4,758,717 issued Jul. 19, 1988). Operation of the terminal either to enter data via the keyboard or from manual actuation of the scanner requires operations by the user which are separate, distinct and apart from normal manual operations such as in picking and placing products in racks, in addition the users are called on to pull triggers thousands of times in a work day and to actuate keyboards by pressing buttons. Such repetitive motion can cause stress and has been found to cause physical injury in certain cases, sometimes called carpal motion sydrome.

Voice recognition technology has been recognized as an advantageous feature for many product applications. Such technology may be employed to render a product partially or entirely controllable by voice commands in situations where hands-on control is impossible or impracticable. Presently, however, voice recognition technology has not found wide use due to the complexity of its implementation, and requirements for a large amount of electronic storage (memory).

Speaker of dependent voice recognition devices are designed to respond to a particular individual. Stored within such devices are speaker specific parameters, such as, for example, variations in the vocal tract response, pitch period, short-term speech power, and amplitude of the short-term speech spectra. In order for a speaker dependent device to respond to more than one person, the voice recognition information (commonly referred to as a "codebook") for each person must be stored within the device. However, mass codebook storage may prove impractical due to space or cost considerations. An alternative may be to use speaker independent technology, however, speaker independent devices are typically more complex and less accurate.

When applied to information communication devices, voice recognition technology raises several concerns. One major concern comprises the recognition that communication devices are typically used by more than one individual. For example, police vehicles are generally in service for three eight hour shifts, during which at least three officers use the vehicle. moreover, the officers using the vehicle (radio) may be anyone on the entire police force. Therefore, each radio must contain a codebook for each officer on the force. This would significantly increase the cost of the radios. Additionally, codebook manintenance costs would be significant since the radios must be updated with each change in personnel. Another concern is the increase in radio size. Contemporary state-of-the-art communication devices are designed so as to minimize their physical size. The addition of serveral memory devices, or a memory printed circuit board, may increase the size of the device beyond that desired by the consumming public. This is a particular concern in the personal pager and handheld radio products.

One solution may be to store the codebooks of only a few individual thereby reducing the amount of required memory. However, this approach is inflexible to changing circumstances such as variations in personnel working hours or in the event that the radio itself should fail. Another approach may be to have each radio contain only enough memory for a single codebook, which must be retrained for each person. Speaker dependent voice recognition devices must be "trained" to respond to each individual. Training is accomplished by having an individual repeat control words serveral times until the device has been "trained" to recognize that word as spoken by that individual. However, training is a time consuming process and may be very inefficient in certain markets, such as police and fire protection, where rapid activity is ordinarily required.

Accordingly, a need exists in the art to permit information communication devices to be programmed to respond to the voice commands of several individuals in an efficient and organized manner.

In recent years, various AV devices such as stereo sets, television receivers, cassette tape decks, video tape decks, compact disk players, laser vision disk players, or the like are equipped with remote control systems.

A remote control system has a transmitter which is usually positioned remotely from a controlled AV device. The transmitter, when operated, transmits a remote control signal, such as an infrared remote control signal, which is received by a receiver in the controlled AV device. The received remote control signal is decoded to control the AV device as intended by the remote control signal.

There has recently been developed a voice-operated remote control system which employs voice control commands instead of control commands entered through keys. The voice-operated remote control system has a microphone mounted on a transmitter for converting a voice command into an electric voice signal, and a speech recognition LSI (Large Scale Integration) circuit for generating a remote control signal which corresponds to a voice pattern represented by the voice signal. The remote control signal thus generated is transmitted to a receiver in a controlled AV device.

In the transmitter of the voice-operated remote control system, a power supply circuit supplies electric energy to the speech recognition LSI circuit, a controller, and other components. In order to process voice commands which may be applied all of a sudden, the speech recognition LSI circuit is normally kept in a standby condition, I.E., remains energized at all times.

If the speech recognition LSI circuit remains energized at all times, then it can also receive other voices than the voices of the operator. As a result, while the AV device is being operated to reproduce recorded sounds, voice signals contained in the reproduced sounds may be entered through the microphone, and the input voice signals may be recognized in error as voice commands, causing an erroneous operation of the AV device.

The speech recognition LSI circuit has a higher power requirement than the usual remote control LSI circuits. Therefore, if the transmitter is battery powered, it may easily malfunction due to a quick voltage drop resulting from the power consumption by the speech recognition LSI circuit.

A transmitter which incorporates a conventional voice-operated remote control system transmits a remote control signal indicative of a control command only when a voice-command is received. When it is desired to repeat one control mode such as for a continuous increase in an audio output power, a voice command for such control mode must be repeated. Such a repeated entry of the same voice command is however inconvenient and tedious.

Accordingly, it may be appreciated that there continues to be a need for a new and improved an audio controlled and activated wristwatch memory aid device as set forth by the instant invention which addresses both the problems of ease of use as well as effectiveness in construction and in this respect, the present invention substantially fulfills this need.

5,226,090

VOICE OPERATED REMOTE CONTROL SYSTEM

Toshiyuki Kimura

A voice-operated remote control system which transmits a remote control signal in response to a voice command has a detector for detecting whether a voice command is received or not. A detected signal from the detector is applied to a power supply control circuit. When there is no voice command received as detected by the detector, the power supply control circuit cuts off electric energy supplied to a speech recognition circuit which consumes the largest amount of electric energy in the voice-operated remote control system. The voice-operated remote control system also has a continuous operation instructing unit which produces an instruction signal that instructs a repetition command to cause a remotely controlled device to repeat an operation. The instruction signal is supplied to a continuous operation control unit which adds the repetition command to the remote control signal that is transmitted to the remotely controlled device.

5,208,449

PORTABLE TRANSACTION TERMINAL

Jay M. Eastman

A headset to be worn around the head of an operator having a head-band, a microphone, a bar code reader, a display, electronics including a microprocessor and speech recognition for translating alphanumeric names and words into data which are to be stored in the memory of the microprocessor and a transceiver for exchanging data with a remotely located modem. Upon a voice activation, messages issued by the microprocessor are visually projected on a display and the reader is initiated.

None of the above noted patents, taken either singly or in combination, are seen to disclose the specific arrangement of concepts disclosed by the present invention.

Numerous innovations for an audio controlled and activated wristwatch memory aid device have been provided in the prior art that are adapted to be used. Even though these innovations may be suitable for the specific individual purposes to which they address, they would not be suitable for the purposes of the present invention as heretofore described.

SUMMARY OF THE INVENTION

It is the principal object of this invention to provide an an audio controlled and activated wristwatch memory aid device for the entry of data by voice recognition and the entry of information of data without the need for triggers or keys special manipulations which interfere with the performance of the user of information management tasks, such as picking and placing of information.

It is a futher object of the present invention to provide an an audio controlled and activated wristwatch memory aid device or data entry terminal where the entry of data and the display of data for prompting and instructing the user and also voice scanning facilities are integrated into a unit which is worn on the head of the user and enables the user to carry on normal operations, such as picking and placing of information in files.

It is still further object of the present invention to provide an audio controlled and activated wristwatch memory aid device which may be implemented in a unit together with facilities for transmitting data entered into the terminal to a display screen or receiving data from voice commands for providing operator prompts and instructions.

Briefly described, an audio controlled and activated wristwatch memory aid device embodying the invention which does not require manual keyboard or code reader actuation is embodied in a unit. An voice command reader is carried on the unit for scanning a voice when actuated. Voice operated means is provided, also carried by the unit for entering transaction data and for actuating the voice reader to scan voice commands and enter data corresponding to the voice commands scanned by the reader.

It is a first object of the present invention to provide an audio controlled and activated wristwatch memory aid device which has a lower power requirement.

A second object of the present invention is to provide an audio controlled and activated wristwatch memory aid device which is capable of having a voice controlled device repeat a desired operation with a voice command which is applied.

According to a first aspect of the present invention, there is provided an audio controlled and activated wristwatch memory aid device comprising a microphone for converting a voice command into an electric signal, speech recognition means for recognizing the voice command based ont he electric signal from the microphone and producing command data corresponding to the voice command, transmitting means for generating and transmitting a remote control signal based on the command data, power supply means, for supplying electric energy to the speech recognition means and transmitting means, detecting means for producing a detected signal indication of whether a voice command is received or not, and power supply control means for cutting off the electric energy from the power supply means to a least the speech recognition means in the absence of a voice command as indicated by the detected signal.

The detecting means detects whether there is received a voice command or not, and produces a detected signal. If there is no voice command as indicated by the detected signal, the power supply control means stops the supply of electric energy from the power supply means through power supply wires to a least the speech recognition means which has the greatest power requirement in the remote control system. Therefore, the remote control system is kept in a standby condition in a low power consumption mode. The remote control system is energized to transmit remote control signals only when it is required to do so. As a result, the remote control system is prevented from being triggered into an erroneous operation due to surrounding noise, and also has a low power requirement.

According to a second aspect of the present invention, there is also provided a voice-operated control system comprising a microphone for converting a voice command into an electric signal, speech recognition means for recognizing the voice command based on the electric signal from the microphone and producing command data corresponding to the voice command, transmitting means for generating and transmitting a remote control signal based on the command data, power supply means for supplying electric energy to the speech recognition means and the transmitting means, continuous operation instructing means for producing an instruction signal to apply a repetition command to repeat an operation to a remotely controlled device, and continuous operation control means for adding the repetition command to the remote control signal in response to the instruction signal.

The continuous operation instructing means produces an instruction signal to apply a repetition command to repeat a desired operation to the remotely controlled device. Based on the instruction signal, the continuous operation control means adds the repetition command to the remote control signal. Therefore, the control system transmits the remote control signal including the repetition command to the controlled device when the voice command is received once. Consequently, the controlled device repeats the same operation.

Since the repetition command which enables the controlled device to repeat the same operation is added to the control signal in response to the instruction signal from the continuous operation instructing means, the controlled device can be controlled to repeat the same operation without the operator's having to give the same voice command repeatedly.

Briefly according to the invention, an individual desiring to operate a communication device via voice commands sends a message to a repository of voice recognition commands requesting access to a particular file. The repository device(s) respond by transmitting the voice of that individual to a least one communication device, which stores the information therein. Thereafter, the communication device may respond to the voice commands of that individual. In this way, the communication device may be rapidly reprogrammed to accommodate changing operators.

With these and other objects in view which will more readily appear as the nature of the invention is better understood, the invention consists in the novel combination and arrangement of parts hereinafter more fully described, illustrated and claimed with reference being made to the attached drawings.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there is illustrated preferred embodiments of the invention.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawing.

BRIEF LIST OF REFERENCE NUMERALS UTILIZED IN THE DRAWING

10—audio wristwatch 10
12—watch band 12
12A—watch band ring 12A
12B—watch band first attachment means 12B
12C—watch band second attachment means 12C
14—display screen 14
14A—displayed message 14A
16—alarm on/off button 16
18—minutes button 18
20—reset button 20
22—next displayed message 22
23—previous displayed message button 23
24—speaker/microphone 24
25—stop button 25
26—watch face 26
26A—watch left side 26A
26B—watch right side 26B
26C—watch top 26C
26D—watch bottom 26D
26E—watch rear 26D
27—time/date adjustment button 27

28—watch/band retaining means 28
30—wrist 30
32—save button 32
34—erase button 34
36—edit button 36
38—train button 38

DETAILED LIST OF REFERENCE NUMERALS UTILIZED IN THE DRAWING

10—audio wristwatch 10 is adjustably mounted on a user's wrist 30 in a easily visible place 12—watch band 12 circumvents the user's wrist 30 and attaches to the audio wristwatch 10 by watch/band retaining means 28 and is adjustably and securely fastened by watch band ring 12A, watch band first attachment means 12B, and watch band second attachment means 12C 12A—watch band ring 12A is securely fastened on one distal end of the watch band 12 having the other distal end threaded therethrough being securely fastened by the watch band first attachment means 12B and watch band second attachment means 12C 12B—watch band first attachment means 12B is securely affixed on the distal end of the watch band 12 and is threaded through the watch band ring 12A being folded back upon itself whereby the watchband first attachment means 12B is securely fastened to the watch band second attachment means 12C which is securely affixed to the same distal end of the watch band 12 at a position further away from the first attachment means 12B toward the opposite distal end 12C—watch band second attachment means which is securely affixed to the distal end of the watch band 12 at a position further away from the first attachment means 12B toward the opposite distal end whereby when the watch band first attachment means 12B is threaded through the watch band ring 12A and folded back upon one another, the first attachment means 12B securely and adjustably fastens to the watch band second attachment means 12C 14—display screen 14 is prominently located on the watch face 26 functioning to display messages 14A and time/date when message is not being displayed 14A—displayed message 14A are displayed on the display screen 14 revealing information such as "APPOINTMENT APR. 30, 1994 2:00PM"

16—alarm on/off button 16 is mounted on the watch face 26 functioning to turn the alarm on and off 18—minutes button 18 is mounted on the watch face 26 functioning to program the set off the alarm at a set number of minutes before the time and date of the task or appointment 20—reset button 20 is mounted on the watch face 26 functioning to reset the audio wrist watch 10 after the appointment and/or task is completed 22—next displayed message button 22 is mounted on the watch face 26 functioning to display the next appointment and/or task in chronological order 23—previous displayed message button 23 is mounted on the watch face 26 functioning to display the previous appointment and/or task in chronological order 24—speaker/microphone 24 is mounted on the watch face 26 functioning to receive and transmit audio signals 25—stop button 25 is mounted on the watch face 26 functioning to end a recorded message 26—watch face 26 is ergonomically designed having the numerous functional buttons, speaker/microphone and display screen arranged in a configuration whereby facilitating the user to utilize the numerous features of the audio wrist watch 10

26A—watch left side 26A is integrally and water resistantly connected to the watch face 26 having the time/date adjustment button 27 located therein 26B—watch right side 26B is integrally and water resistantly connected to the watch face 26

26C—watch top 26C is integrally and water resistantly connected to the watch face 26

26D—watch bottom 26D is integrally and water resistantly connected to the watch face 26 having watch/band retaining means 28 securely mounted thereon 26E—watch rear 26D s integrally and water resistantly connected to the watch face 26

27—time/date adjustment button 27 is mounted on the watch face 26 functioning to enable the user to set and reset the proper date and time 28—watch/band retaining means 28 is securely mounted on the watch bottom 26D functioning to securely fasten the audio wristwatch 10 to the watch band 12

30—user's wrist 30 upon which the audio wristwatch is adjustably and securely mounted 32—save button 32 is mounted on the watch face 26 functioning to enable the user to save recorded messages 34—erase button 34 is mounted on the watch face 26 functioning to enable the user to erase recorded messages 36—edit button 36 is mounted on the watch face 26 functioning to enable the user to edit recorded messages 38—train button 38 is mounted on the watch face 26 functioning to enable the user to train the audio wristwatch 10 to distinguish his/her own person voice commands

DETAILED DESCRIPTION OF THE PREFERRED EMBODIMENT

Figure 1:
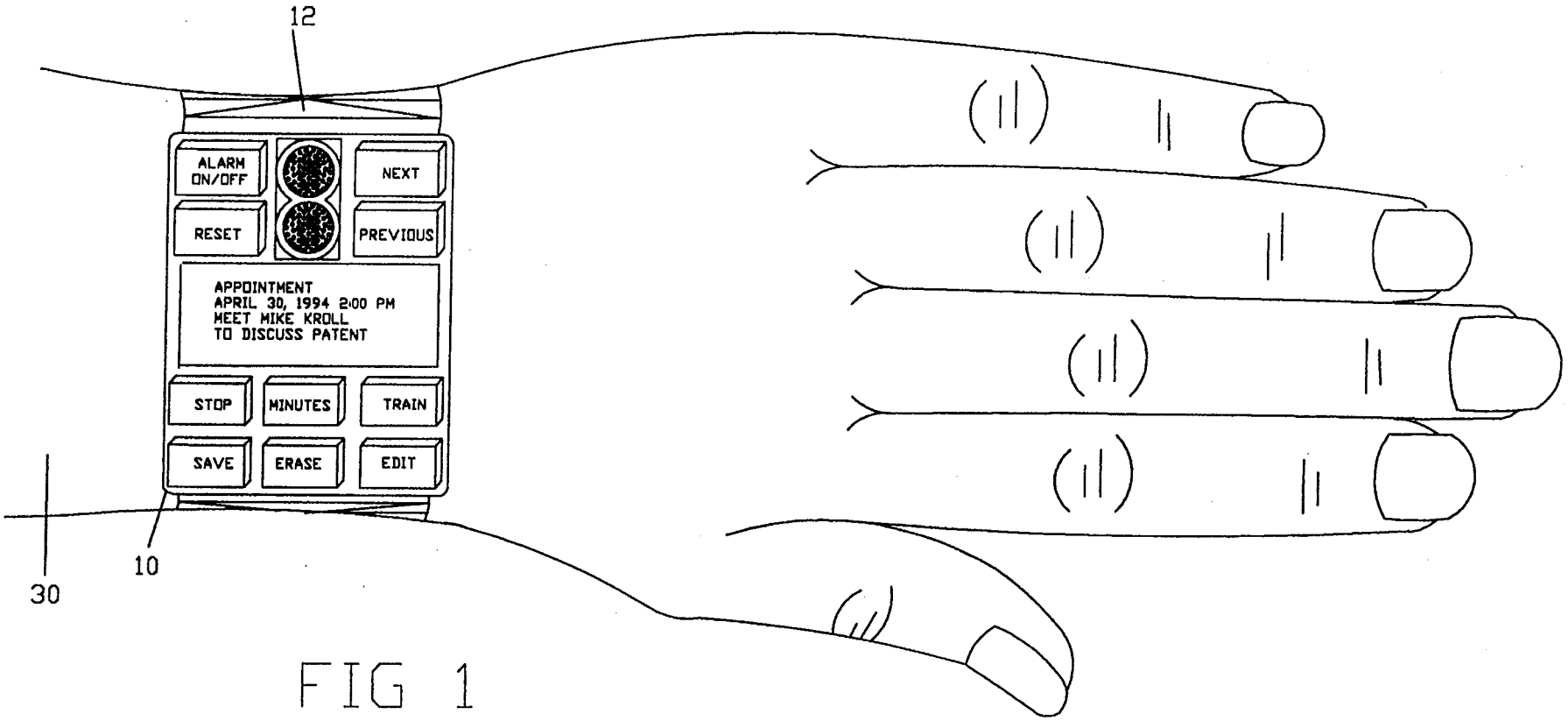
FIG. 1 is a side view of the audio wristwatch adjustably and securely mounted on the user's wrist

Firstly, referring to FIG. 1 which is a top view of the audio wristwatch adjustably and securely mounted on the user's wrist exhibiting the following features: audio wristwatch 10 is adjustably mounted on a user's wrist 30 in a easily visible place; watch band 12 circumvents the user's wrist 30 and attaches to the audio wristwatch 10 by watch/band retaining means 28 and is adjustably and securely fastened by watch band ring 12A, watch band first attachment means 12B, and watch band second attachment means 12C; and user's wrist 30 upon which the audio wristwatch is adjustably and securely mounted.

Figure 2:
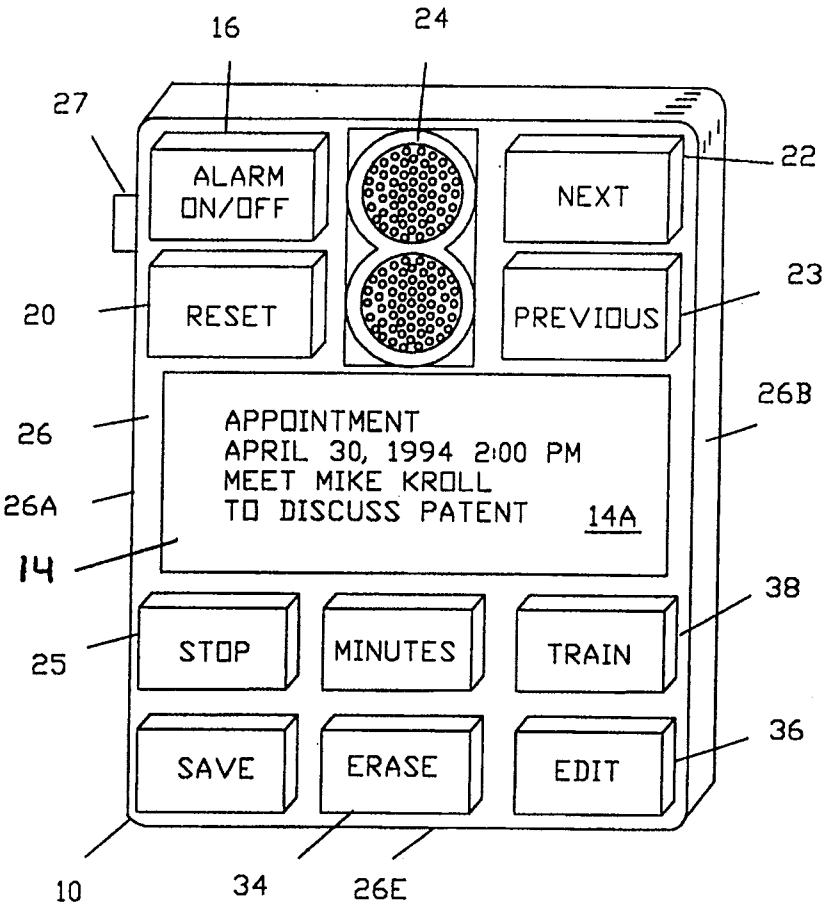
FIG. 2 is a top view of the audio wristwatch and watch band

Now referring to FIG. 2 which is a top view of the audio wristwatch and watch band exhibiting the following features: audio wristwatch 10 is adjustably mounted on a user's wrist 30 in a easily visible place; watch band 12 circumvents the user's wrist 30 and attaches to the audio wristwatch 10 by watch/band retaining means 28 and is adjustably and securely fastened by watch band ring 12A, watch band first attachment means 12B, and watch band second attachment means 12C; watch band ring 12A is securely fastened on one distal end of the watch band 12 having the other distal end threaded therethrough being securely fastened by the watch band first attachment means 12B and watch band second attachment means 12C; watch band first attachment means 12B is securely affixed on the distal end of the watch band 12 and is threaded through the watch band ring 12A being folded back upon itself whereby the watch band first attachment means 12B is securely fastened to the watch band second attachment means 12C which is securely affixed to the same distal end of the watch band 12 at a position further away from the first attachment means 12B toward the opposite distal end; watch band second attachment means 12C which is securely affixed to the distal end of the watch band 12 at a position further away from the first attachment means 12B toward the opposite distal end whereby when the watch band first attachment means 12B is threaded through the watch band ring 12A and folded back upon one another, the first attachment means 12B securely and adjustably fastens to the watch band second attachment means 12C; display screen 14 is prominently located on the watch face 26 functioning to display messages 14A; displayed message 14A are displayed on the display screen 14 revealing information such as "APPOINTMENT APR. 30, 1994 2:00PM"; alarm on/off button 16 is mounted on the watch face 26 functioning to turn the alarm on and off; minutes button 18 is mounted on the watch face 26 functioning to program the set off the alarm at a set number of minutes before the time and date of the task or appointment; reset button 20 is mounted on the watch face 26 functioning to reset the audio wrist watch 10 after the appointment and/or task is completed; next displayed message button 22 is mounted on the watch face 26 functioning to display the next appointment and/or task in chronological order; previous displayed message button 23 is mounted on the watch face 26 functioning to display the previous appointment and/or task in chronological order; speaker/microphone 24 is mounted on the watch face 26 functioning to receive and transmit audio signals; stop button 25 is mounted on the watch face 26 functioning to end a recorded message; watch face 26 is ergonomically designed having the numerous functional buttons, speaker/microphone and display screen arranged in a configuration whereby facilitating the user to utilize the numerous features of the audio wrist watch 10; watch left side 26A is integrally and water resistantly connected to the watch face 26 having the time/date adjustment button 27 located therein; watch right side 26B is integrally and water resistantly connected to the watch face 26; watch top 26C is integrally and water resistantly connected to the watch face 26; watch bottom 26D is integrally and water resistantly connected to the watch face 26 having watch/band retaining means 28 securely mounted thereon; watch rear 26D s integrally and water resistantly connected to the watch face 26; time/date adjustment button 27 is mounted on the watch face 26 functioning to enable the user to set and reset the proper date and time; watch/band retaining means 28 is securely mounted on the watch bottom 26D functioning to securely fasten the audio wristwatch 10 to the watch band 12; user's wrist 30 upon which the audio wristwatch is adjustably and securely mounted; save button 32 is mounted on the watch face 26 functioning to enable the user to save recorded messages; erase button 34 is mounted on the watch face 26 functioning to enable the user to erase recorded messages; edit button 36 is mounted on the watch face 26 functioning to enable the user to edit recorded messages; and train button 38 is mounted on the watch face 26 functioning to enable the user to train the audio wristwatch 10 to distinguish his/her own person voice commands.

Figure 3:
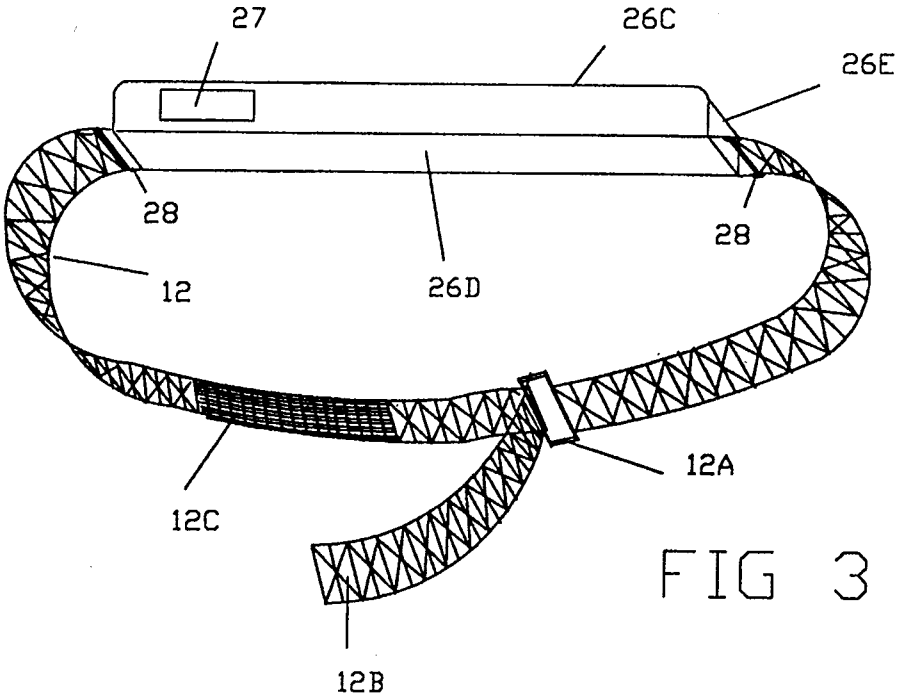
FIG. 3 is a side view of the audio wrist watch and watch band

Now referring to FIG. 3 which is a side view of the audio wrist watch and watch band exhibiting the following features: audio wristwatch 10 is adjustably mounted on a user's wrist 30 in a easily visible place; watch band 12 circumvents the user's wrist 30 and attaches to the audio wristwatch 10 by watch/band retaining means 28 and is adjustably and securely fastened by watch band ring 12A, watch band first attachment means 12B, and watch band second attachment means 12C; watch band ring 12A is securely fastened on one distal end of the watch band 12 having the other distal end threaded therethrough being securely fastened by the watch band first attachment means 12B and watch band second attachment means 12C; watch band first attachment means 12B is securely affixed on the distal end of the watch band 12 and is threaded through the watch band ring 12A being folded back upon itself whereby the watch band first attachment means 12B is securely fastened to the watch band second attachment means 12C which is securely affixed to the same distal end of the watch band 12 at a position further away from the first attachment means 12B toward the opposite distal end; watch band second attachment means 12C which is securely affixed to the distal end of the watch band 12 at a position further away from the first attachment means 12B toward the opposite distal end whereby when the watch band first attachment means 12B is threaded through the watch band ring 12A and folded back upon one another, the first attachment means 12B securely and adjustably fastens to the watch band second attachment means 12C; watch left side 26A is integrally and water resistantly connected to the watch face 26 having the time/date adjustment button 27 located therein; watch top 26C is integrally and water resistantly connected to the watch face 26; watch bottom 26D is integrally and water resistantly connected to the watch face 26 having watch/band retaining means 28 securely mounted thereon; watch rear 26D s integrally and water resistantly connected to the watch face 26; and watch/band retaining means 28 is securely mounted on the watch bottom 26D functioning to securely fasten the audio wristwatch 10 to the watch band 12.

Figure 4:
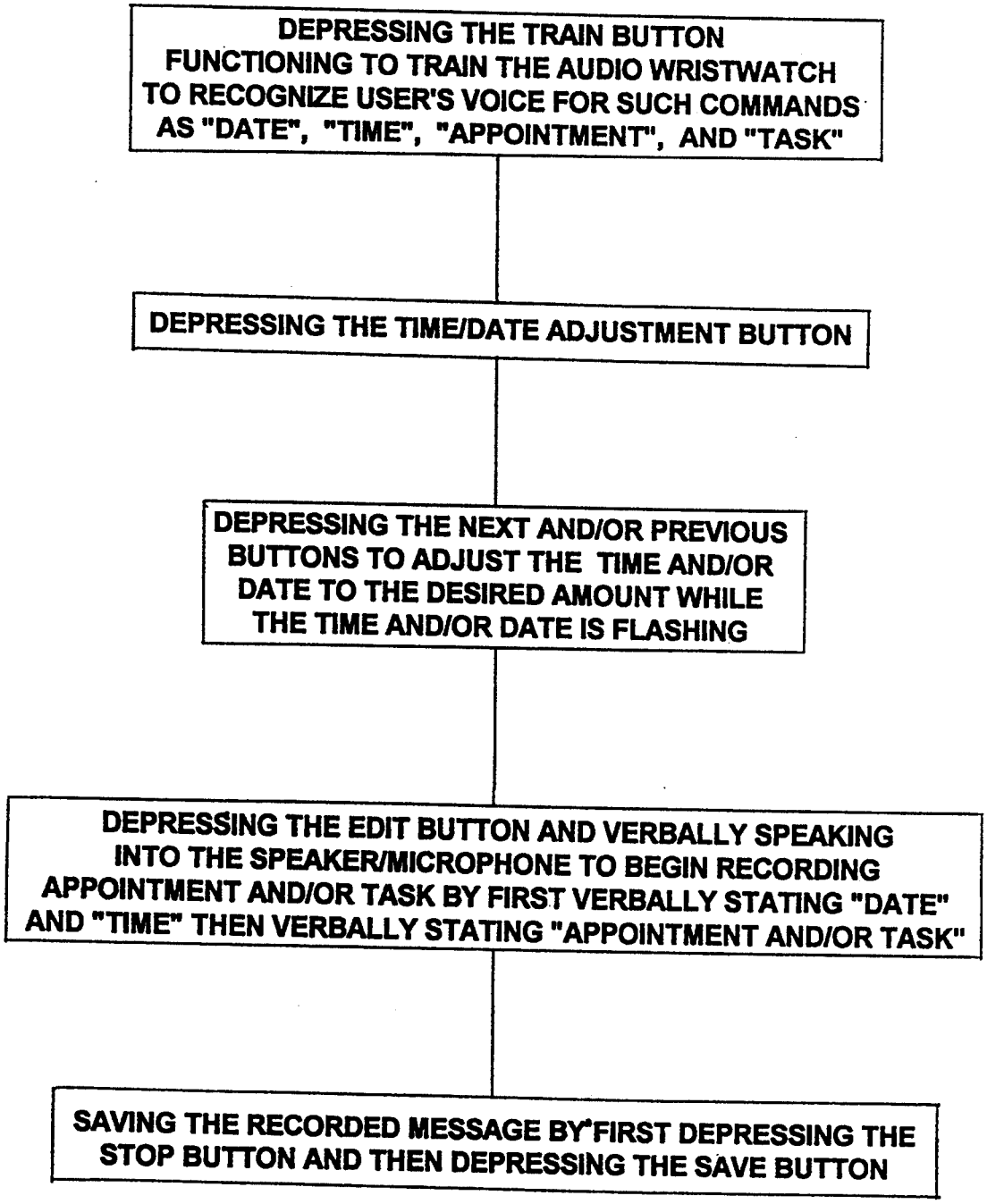
FIG. 4 is a flow diagram of the steps by which the audio wristwatch recording a message functions

Now referring to FIG. 4 which is a flow diagram of the steps by which the audio wristwatch recording a message functions exhibiting the following steps:

a) depressing the train button functioning to train the audio wristwatch to recognize user's voice for such commands as "Date", "Time" Appointment", and "Task", b) Depressing the next and/or previous button to adjust the time/date to adjust the time and/or date to the desired amount while the time and/or date is flashing, c) Depressing the edit button and verbally speaking into the speaker/microphone to begin recording appointment and/or task by first verbally stating "Date" and "Time" then verbally stating "Appointment and/or Task", and d) Saving the recorded message by first depressing the stop button and then depressing the save button.

Figure 5:
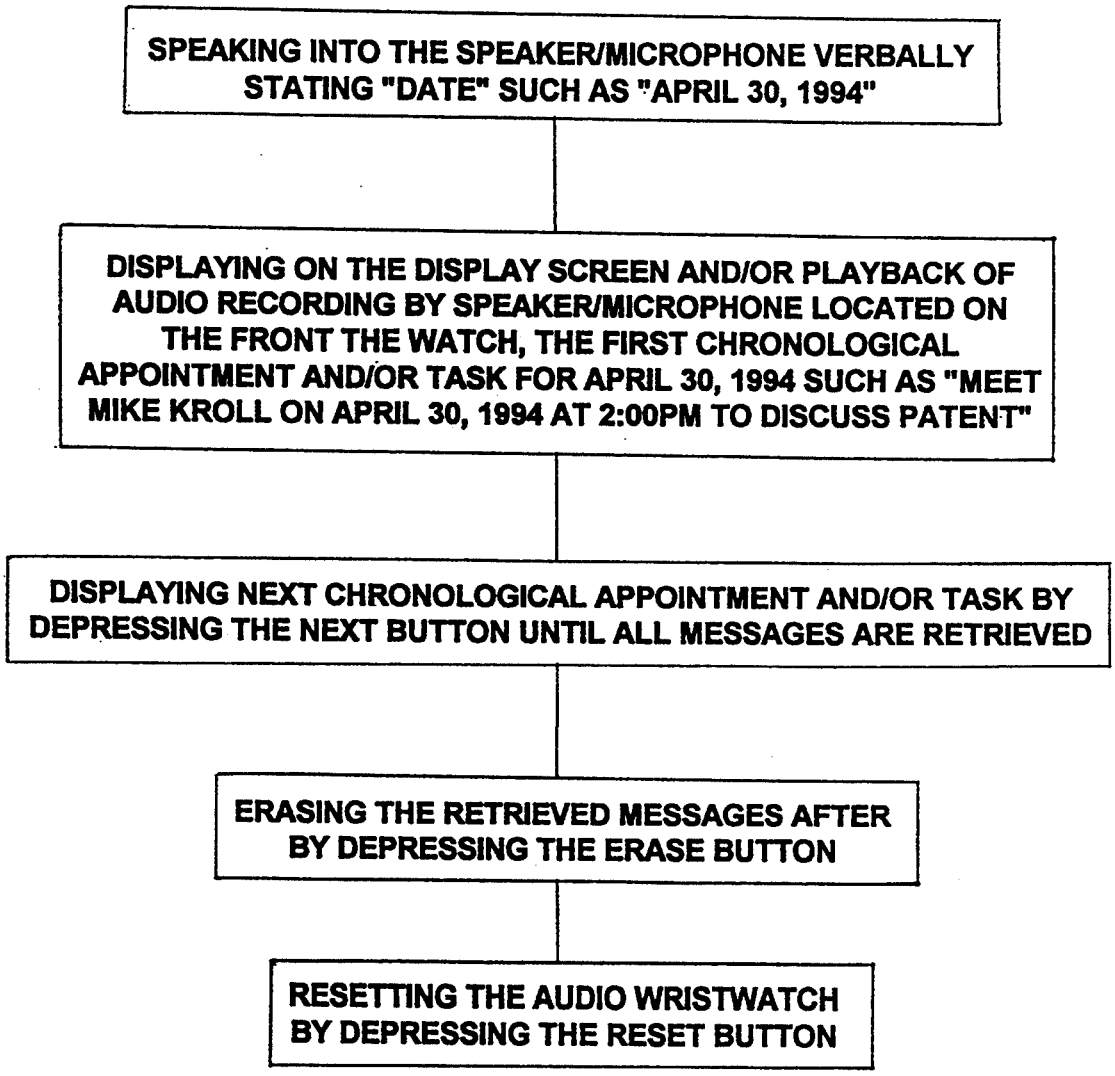
FIG. 5 is a flow diagram of the steps by which the audio wristwatch band retrieving a message functions

Now referring to FIG. 5 which is a flow diagram of the steps by which the audio wristwatch band retrieving a message functions exhibiting the following steps:

a) Speaking into the speaker/microphone verbally stating "Date" such as "Apr. 30, 1994", b) Displaying on the display screen and/or playback of the audio recording by speaker/microphone located on the front the watch, the first chronological appointment and/or task for Apr. 30, 1994 such as "Meet Mike Kroll on Apr. 30, 1994 at 2:00 PM to discuss patent", c) Displaying next chronological appointment and/or task by depressing the next button until all messages are retrieved, d) erasing the retrieved messages after by depressing the erase button, and e) resetting the audio wristwatch by depressing the reset button.

Figure 6:
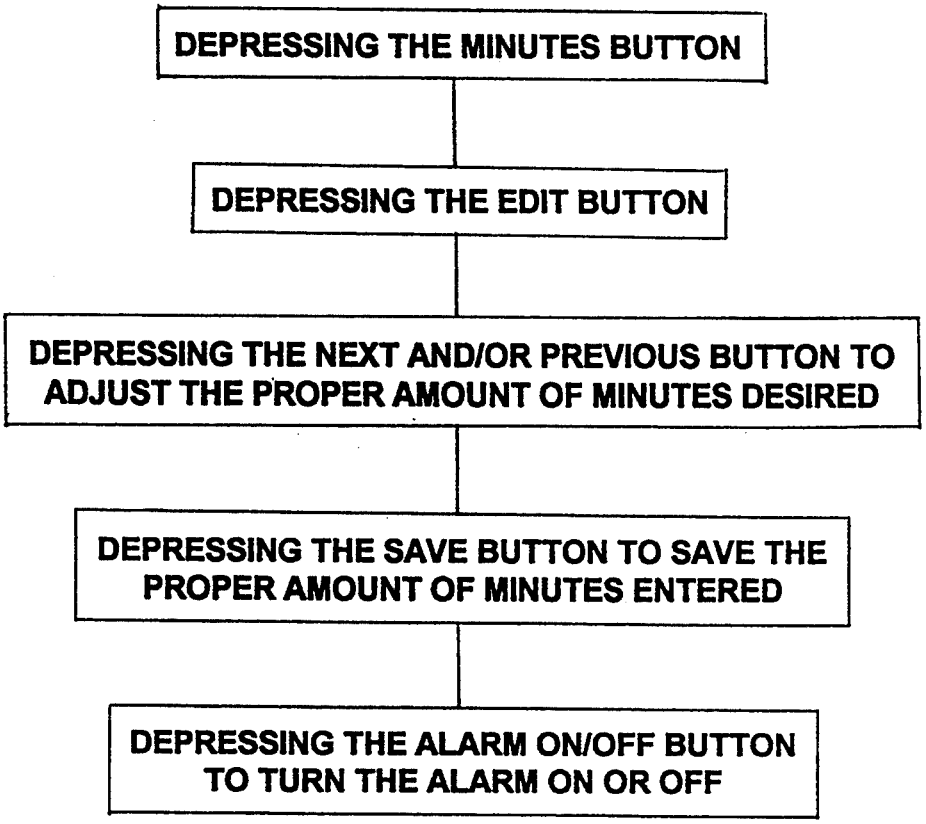
FIG. 6 is a flow diagram of the steps by which the audio wristwatch band setting the alarm functions

Lastly, referring to FIG. 6 which is a flow diagram of the steps by which the audio wristwatch band setting the alarm functions exhibiting the following steps:

a) depressing the minutes button, b) depressing the edit button, c) depressing the next and/or previous button to adjust the proper amount of minutes desired, d) depressing the save button to save the proper amount of minutes entered, and e) depressing the alarm on/off button to turn alarm on or off.

It will be understood that each of the elements described above, or two or more together, may also find a useful application in other types of constructions differing from the type described above.

While the invention has been illustrated and described as embodied in an audio wristwatch, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. An audio wristwatch being adjustably mounted upon a user's wrist in a easily visible place comprising:

a) a watch band circumventing said user's wrist attaching to said audio wristwatch by a watch band retaining means being adjustably and securely fastened by a watch band ring, at least one watch band first attachment means, and at least one watch band second attachment means;

b) at least one display screen prominently positioned upon a watch face functioning to display messages;

c) at least one alarm on/off button mounted upon said watch face functioning to turn an alarm on and off;

d) at least one minutes button mounted on said watch face functioning to program and activate said alarm at a preset number of minutes before a specifically preprogrammed time and date of a task or appointment;

e) at least one reset button mounted on said watch face functioning to reset said audio wrist watch after said appointment and task being completed;

f) at least one next displayed message button mounted on said watch face functioning to display said next appointment and task in a chronological order;

g) at least one previous displayed message button mounted on said watch face functioning to display said previous appointment and task in a chronological order;

h) at least one speaker/microphone mounted on said watch face functioning to receive and transmit audio signals;

i) at least one stop button mounted on said watch face functioning to end said recorded message;

j) at least one time/date adjustment button mounted on said watch face enabling said user to set and reset said proper date and time;

k) at least one save button mounted on said watch face enabling said user to save recorded messages;

l) at least one erase button mounted on said watch face enabling said user to erase recorded messages;

m) at least one edit button mounted on said watch face enabling said user to edit recorded messages;

n) at least one train button mounted on said watch face enabling said user to train said audio wristwatch to distinguish his/her own personal voice commands;

o) a housing; and p) a powering means.

2. An audio wristwatch as described in claim 1, whereas said watch band having a watch band ring securely fastened at one distal end of said watch band having another distal end threaded therethrough being securely fastened by said watch band first attachment means and said watch band second attachment means.

3. An audio wristwatch as described in claim 2, whereas said watch band having a watch band first attachment means securely affixed on a distal end of said watch band being threaded through said watch band ring being folded back upon itself whereby said watch band first attachment means is securely fastened to said watch band second attachment means being securely affixed to the same distal end of said watch band at a position further away from said first attachment means toward an opposite distal end.

4. An audio wristwatch as described in claim 3, whereas said watch band having a watch band second attachment means which is securely affixed to a distal end of said watch band at a position further away from said first attachment means toward an opposite distal end whereby when said watch band first attachment means is threaded through said watch band ring and folded back upon one another, said first attachment means securely and adjustably fastens to said watch band second attachment means.

5. An audio wristwatch as described in claim 1, whereas said display screen having a displayed message displayed thereon said display screen revealing information such as "APPOINTMENT APR. 30, 1994 2:00PM".

6. An audio wristwatch as described in claim 1, whereas said watch band having a watch band retaining means securely mounted on said watch bottom functioning to securely fasten said audio wristwatch to said watch band.

7. An audio wristwatch as described in claim 1, whereas said housing being manufactured from a group of materials such as; plastic, petroleum distillates, metal, metal alloys, epoxy, carbon graphite, fiberglass, and recyclable materials.

8. An audio wristwatch as described in claim 1, whereas said powering means being solar power.

9. An audio wristwatch as described in claim 1, whereas said powering means being at least one battery.

* * * * *

UNITED STATES PATENT AND TRADEMARK OFFICE

CERTIFICATE OF CORRECTION

PATENT NO. : 5,444,673

DATED : August 22, 1995

INVENTOR(S) : Trevor S. Mathurin

It is certified that error appears in the above–identified patent and that said Letters Patent is hereby corrected as shown below:

On the title page, item [54] and column 1, lines 2-3, the title should read --AUDIO CONTROLLED AND ACTIVATED WRISTWATCH MEMORY AID DEVICE--

Signed and Sealed this

Twentieth Day of February, 1996

*Attest:*

Bruce Lehman

BRUCE LEHMAN

*Attesting Officer*

*Commissioner of Patents and Trademarks*